United States Patent [19]

Gist

[11] 4,014,592

[45] Mar. 29, 1977

[54] RETRACTABLE CHAIR FOR SMALL CHILDREN

[76] Inventor: Lanny J. Gist, 840 Pearl St., Bowling Green, Ohio 43402

[22] Filed: Jan. 22, 1975

[21] Appl. No.: 542,942

Related U.S. Application Data

[63] Continuation of Ser. No. 437,070, Jan. 28, 1974.

[52] U.S. Cl. ..... 297/143; 297/142

[51] Int. Cl.[2] ..... A47C 9/04

[58] Field of Search ..... 297/174, 134, 135, 143, 297/142, 141, 140; 248/210; 5/96

[56] References Cited

UNITED STATES PATENTS

| | | | |
|---|---|---|---|
| 887,529 | 5/1908 | Schnee | 5/96 |
| 1,501,443 | 7/1924 | Ellis | 297/143 |
| 1,525,011 | 2/1925 | Stoltz | 297/142 |
| 2,439,430 | 4/1948 | Hurd | 248/210 |
| 2,493,187 | 1/1950 | Ducey | 297/174 |
| 2,956,617 | 10/1960 | Bruderer et al. | 297/141 |
| 2,961,034 | 11/1960 | Huffaker | 297/142 |
| 3,021,185 | 2/1962 | Kowalczyk | 297/143 X |
| 3,133,760 | 5/1964 | Robinson | 297/174 |
| 3,160,437 | 12/1964 | Hill | 297/143 |
| 3,397,010 | 8/1968 | Leimgruber | 297/174 |

FOREIGN PATENTS OR APPLICATIONS

| | | | |
|---|---|---|---|
| 281,700 | 3/1952 | Switzerland | 297/174 |

*Primary Examiner*—James T. McCall
*Attorney, Agent, or Firm*—John E. Reilly

[57] ABSTRACT

A retractable baby or child's chair is provided. The chair is supported below a table top and is movable between a retracted, storage position and an extended, operable position. In a preferred form, a seat and back are mounted in a tubular frame which is slidably supported in tracks affixed to a lower surface of the table top. The frame, along with the seat and the back, then can slidably move between a retracted position under the table top and an extended position protruding beyond the edge of the table to support a child in an eating position. The seat and the back preferably are pivotally supported by the frame so as to fold when moved to the retracted position and not interfere with knee room under the table. Alternately, the baby chair can be constructed of angular channel members or can be of wood with a fixed seat and a pivoted back and arms. The back and arms can be designed to open automatically when the chair is pulled from the retracted to the extended position and to fold automatically when the chair is moved back toward the retracted position.

8 Claims, 11 Drawing Figures

FIG. 1
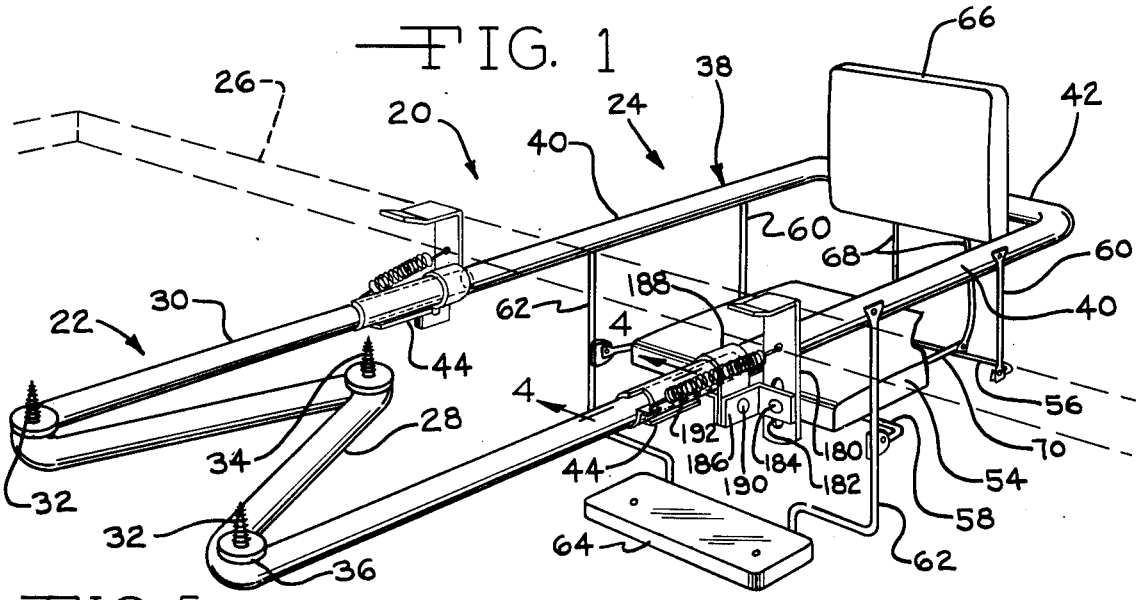
FIG. 5
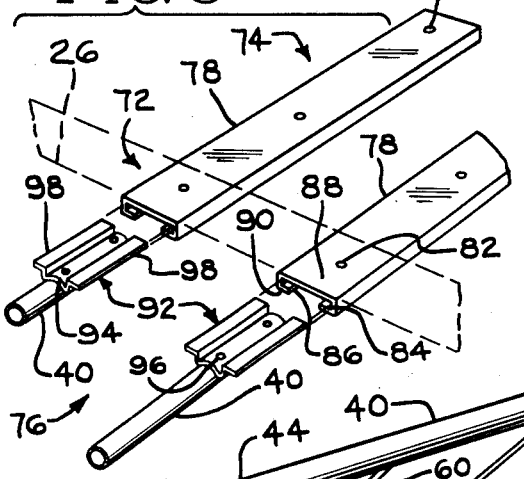
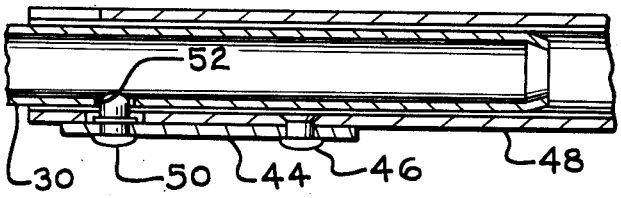
FIG. 4
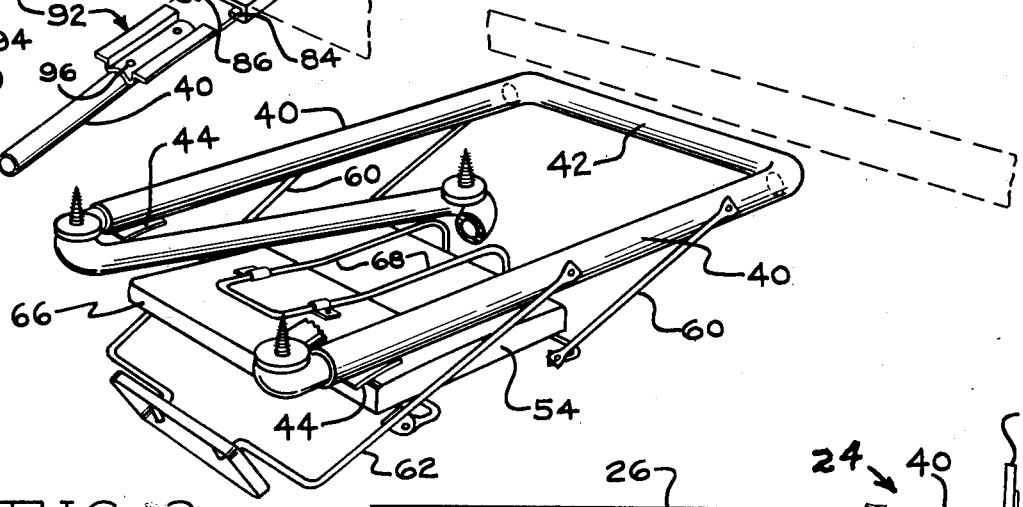
FIG. 3
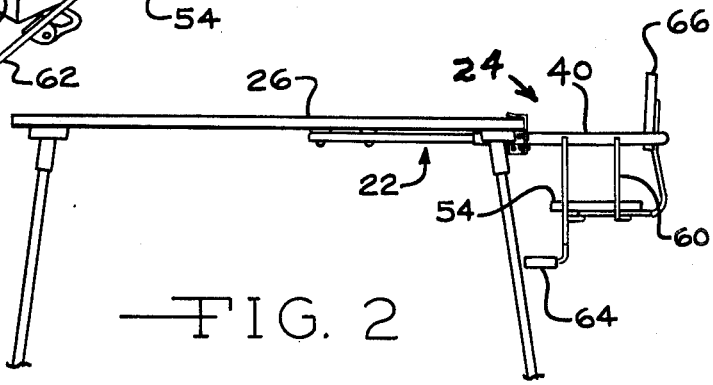
FIG. 2

RETRACTABLE CHAIR FOR SMALL CHILDREN

This is a continuation of application Ser. No. 437,070 filed Jan. 28, 1974.

This invention relates to a retractable chair and particularly to a retractable high chair for babies and small children.

The new retractable chair is supported under a table, specifically by a supporting unit affixed to the bottom surface of the table top, which unit movably supports the frame of the chair so that the chair can be moved from a retracted, storage position in which it is totally under the table top to an extended position in which it protrudes beyond the table top, so that a seat thereof is exposed. The child can be placed on the seat and is then in an eating position relative to the table top. With this arrangement, there is no need for a separate special tray as is commonly used with a high chair and the seat is always at the proper position relative to the table top even for tables of various heights. Further, there is no danger of the child tipping over the chair as is possible with a high chair. A particular advantage is the fact that when the chair is in the retracted position, it does not consume any extra useable space at all. This is in sharp contrast to the common high chair which consumes considerable floor space, which can be a particular disadvantage in smaller homes, mobile homes, camping trailers, etc. Not only is the consumption of floor space eliminated, but the new chair is not in the way when the floor is to be cleaned or waxed. The new retractable chair is also less expensive than most high chairs which require a sizable stand along with a tray and other accessories.

In a preferred form, the retractable chair includes a supporting member affixed below a table top having a pair of tracks or legs extending toward an edge thereof. Legs of a chair frame are slidably supported by the tracks or legs of the supporting member and can be moved from a retracted position below the table top to an extended position. The frame pivotally supports a seat and a seat back which can be folded when the chair is moved to the retracted position. The chair can also be made with an angular channel frame or can be made of a wooden, drawer-type construction with a fixed seat and with a pivotal back and arms. Means also can be provided for automatically moving the back and arms between folded and operable positions, if desired.

It is, therefore, a principal object of the invention to provide a chair for babies or small children which can be supported directly by a table.

Another object of the invention is to provide a chair of the type described which can be moved between a retracted, storage position under a table and an extended, operable position.

A further object of the invention is to provide a chair of the type described having a frame and supporting means which slidably supports the frame below a table top for slidable movement between retracted and extended positions.

Many other objects and advantages of the invention will be apparent from the following detailed description of preferred embodiments thereof, reference being made to the accompanying drawings, in which:

FIG. 1 is a view in perspective of a chair embodying the invention, shown in an extended position, with a table top shown in dotted lines;

FIG. 2 is a side view in elevation of the chair of FIG. 1, along with a portion of the table;

FIG. 3 is a view in perspective similar to FIG. 1, but with the chair shown in a retracted position;

FIG. 4 is an enlarged, transverse sectional view taken along the line 4—4 of FIG. 1;

FIG. 5 is a fragmentary, somewhat schematic view in perspective of a portion of a slightly modified chair support;

Figure 7:
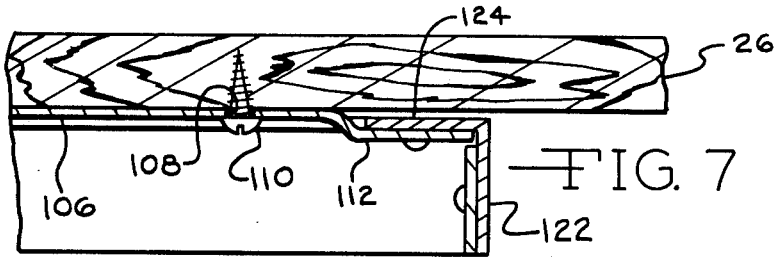
FIG. 7 is an enlarged, fragmentary view in transverse cross section taken along the line 7—7 of FIG. 5.

Referring to FIGS. 1–4, a retractable chair according to the invention is indicated at 20 and includes a supporting unit 22 and a seating unit 24. The supporting unit 22 is affixed to the lower surface of a table top 26 and includes an "M" shaped tube consisting of a V-shaped tubular portion 28 and two legs or track members 30. The V-shaped portion 28 is affixed to the underside of the table top 26 by two screws 32, located at the ends of the V-shaped portion 28 and by a screw 34 located at the tip of the V-shaped portion. Washers 36 space the V-shaped portion 28 and the legs 30 slightly below the lower surface of the table top 26 to receive the seating unit 24. Rather than using the washers 36, the legs 30 can be offset from the plane of the V-shaped portion 28, if desired.

The seating unit 24 includes a U-shaped frame 38 having legs 40 connected by a web 42. The legs 40 are slightly larger than the diameter of the legs 30 so as to be telescopically received thereover for support thereby. Near the ends of the legs 40 are leaf springs 44, each affixed at one end by a rivet 46 to the leg 40 and having a pin 50 at the opposite end resiliently urged by the spring 44 toward the corresponding leg 30 of the supporting member 22. The legs 30 have openings 52 appropriately positioned therein to receive the pins 50 so as to limit the outward movement of the seating unit 24 from a retracted position (FIG. 3) below the table top 26 to an extended, operable position shown in FIG. 1. The leaf springs 44 can simply be pulled out to release the pins 50 from the holes 52 in order to move the seating unit 24 back to the retracted position.

A seat 54 of the chair is supported on rear and forward cross rods 56 and 58. The rear cross rod 56 is pivotally connected to lower ends of depending rear rods 60 which are pivotally connected at their upper ends to the walls of the tubular frame legs 40 by rivets. The rods can also be pivotally connected to bars extending downwardly from the frame leg walls, if desired. The forward cross rod 58 is similarly pivotally connected to depending front rods 62 which are also pivotally connected to the walls of the frame legs 40. If desired, the lower portions of the forward depending rods 62 can be connected to a foot rest 64 for the child.

A seat back 66 is located behind a rear edge of the seat 54 and is pivotally connected through supporting rods 68 to lower rods 70 which are affixed to the cross rods 56 and 58. The back 66 can then be folded forwardly and downwardly, as shown in FIG. 3. At the same time, the depending rods 60 and 62 can be swung forwardly to the position of FIG. 3 so as to occupy a minimum amount of space or knee room under the table top 26 when the seating unit 24 is pushed into the retracted position after the pins 50 are released from the holes 52.

A portion of a slightly modified retractable chair according to the invention is shown in FIG. 5 and is indicated at 72. The chair 72 includes a modified supporting unit 74 and a modified seating unit 76. The supporting unit 74 includes two legs or tracks 78, each of which is affixed to the lower surface of the table top 26 by three screws 80 extending through holes 82 in the track. Each of the tracks 78 has a channel 84 and a slot 86 formed by a back 88 and inwardly-extending flanges 90.

The seating unit 76 includes a U-shaped frame similar to the frame 38 and having the legs 40 to the ends of which are affixed glides 92. Each of the glides 92 consists of a U-shaped portion 94 affixed to the end of the leg by rivets 96 with horizontally-extending flanges 98 extending outwardly above and to the sides of the leg 40. The U-shaped portion 94 extends through the slot 86 in the corresponding track 78 and the glide flanges 98 are supported on the track flanges 90. Suitable stop pins can be employed near the outer ends of the tracks 74, if desired.

Figure 6:
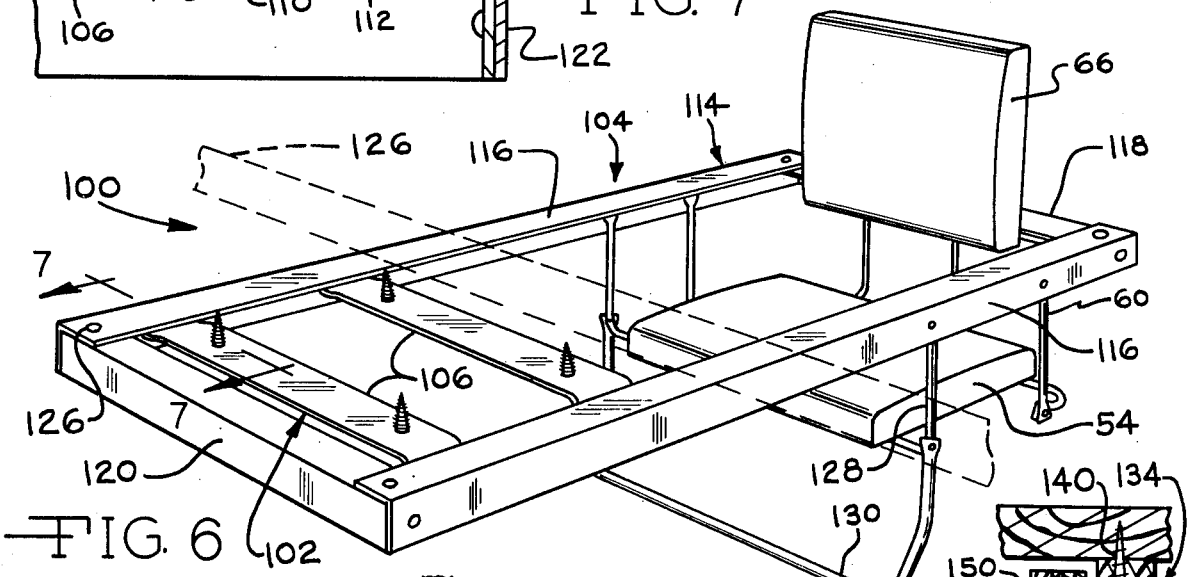
FIG. 6 is a view in perspective, similar to FIG. 1, of a modified chair embodying the invention, shown in the extended position.
Figure 11:
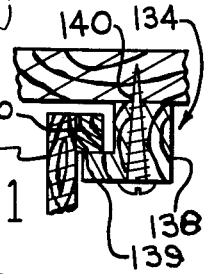
FIG. 11 is a fragmentary view in section taken along the line 11—11 of FIG. 8.

A modified retractable chair 100 is shown in FIGS. 6 and 7 and includes a supporting unit 102 and a seating unit 104. The supporting unit 102 has two track members or straps 106 which are spaced apart such that one is near the edge of the table top 26 and the other is positioned inwardly to act as a stop when the seating unit 104 is extended to the operable or eating position, substantially as shown. As shown in FIG. 7, the straps 106 have openings 108 therein which receive screws or other suitable fasteners 110. Ends of the straps 106 are offset to form horizontally-extending flanges 112 spaced from the lower surface of the top 26.

The seating unit 104 includes a rectangular-shaped frame 114 having legs 116 connected by an outer web 118 and an inner web 120. These maintain the proper spacing of the legs 116 so that they cooperate fully with the flanges 112 of the straps 106. Each of the legs 116 and the webs 118 and 120 are of angular configuration as shown in FIG. 7 with a vertical leg 122 and a horizontal leg 124 cooperating with the flange 112. The legs and webs are suitably connected at their ends by rivets 126.

The seating unit 104 of the chair 100 can otherwise be similar to the seating unit 24 of the chair 20. However, shorter front depending legs 128 are substituted for the front legs 62 of the unit 24, and a U-shaped tubular member 130 is pivotally connected to the legs 128 in place of the foot rest 64.

Referring now to FIGS. 8–11, a modified retractable chair according to the invention is indicated at 132 and includes a supporting unit 134 and a seating unit 136. The supporting unit 134 has L-shaped wooden track members 138 having inwardly-extending horizontal flange portions 139. The track members can be affixed to the table top 26 by means of screws 140.

The seating unit 136 in this instance includes a rectangular shaped wooden frame 142 having two sides or legs 144, an outer connecting web or front 146 and an inner connecting web or end 148. Wooden rails 150 form outwardly-extending flanges which cooperate with the flanges 139 of the track members 138 to support the frame 142 immediately under the table top 26 for movement between extended and retracted positions, the extended position being determined by a stop 152 which contacts the end 148.

A seat 154 is located between approximately the outer halves of the legs 144 and extends to the front 146. A back 156 is pivotally attached to the outer edge portion of the seat by hinges 158, and arms 160 are pivotally attached to side edge portions of the seat 154 by hinges 162. The seat, back, and arms can be made of a thin, hardboard material and suitably covered with foam-backed vinyl sheeting, if desired.

Figure 10:
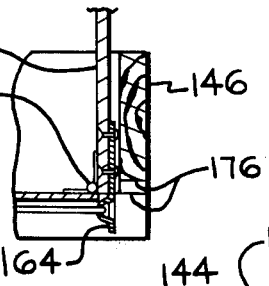
FIG. 10 is a fragmentary view in section taken along the line 10—10 of FIG. 8.
Figure 8:
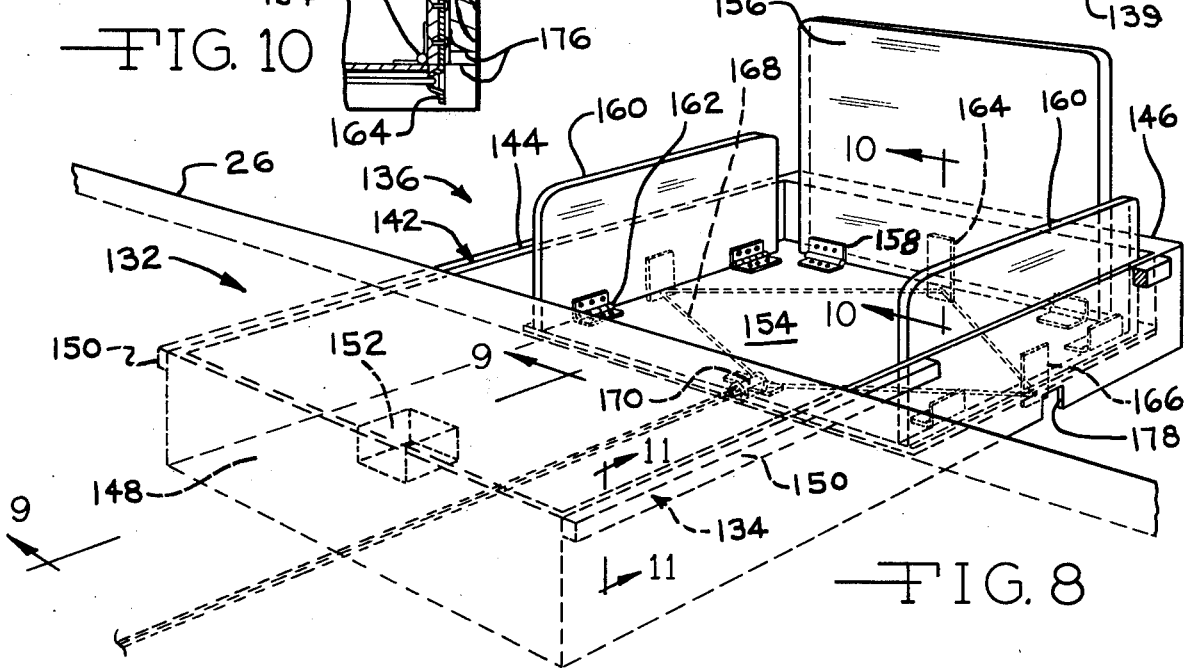
FIG. 8 is a view in perspective, similar to FIG. 6, of another modified chair according to the invention.
Figure 9:
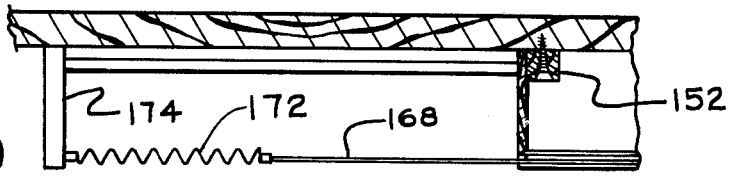
FIG. 9 is a fragmentary view in longitudinal cross section, taken along the line 9—9 of FIG. 8.

The back 156 and the arms 160 can be caused to automatically open when the seating unit 136 is moved to the extended position, as shown. For this purpose, the back 156 has a downwardly-extending tab 164 attached thereto and extending slightly below the seat 154, as shown in FIG. 10. Each of the arms 160 has a similar tab 166. A wire 168 connects the three tabs 164 and 166 and extends through a tube or guide 170 to a spring 172 (FIG. 9) which is suitably connected to a fixed member 174 under the table top 26. When the seating unit 136 is pulled to the extended position, the wire 168 pulls the tabs 164 and 166 toward the center of the seat 154 and thereby moves the back 156 and the arms 160 upwardly to the extended position. When the seating unit 156 is moved to the retracted position, the back and arms can move downwardly to the folded positions by gravity, at which time, the lower end of the tab 164 moves outwardly into a notch 176 in the front 146 and the lower ends of the tabs 166 move outwardly into notches 178 in the sides 144.

Safety catches can be employed on the chair frame, if desired. Referring to FIG. 1, an L-shaped catch 180 is designed to extend over the edge of the table top 26. The catch has a lower slot 182 through which a fastener 184 extends to connect the catch with a bracket 186. The catch thereby can be adjusted vertically to accommodate table tops of different thicknesses. The bracket 186, in turn, is pivotally connected to a collar 188 which extends around each of the tubular legs 40 and is frictionally held thereon by a fastener 190 which also pivots the collar to the bracket 186. The catch 180 is urged to the upright position by a spring 192. When the seat is moved to the retracted position, the catch 180 can be swung backward and downwardly.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. A retractable chair for small children comprising a frame having two parallel legs, means for slidably supporting said legs below a top of a table for movement of said frame between a retracted position below the table top and an extended position in which a substantial portion of said frame extends beyond an edge of the table top, a seat, two parallel links connecting said seat to one of said frame legs and two parallel links connecting said seat to the other leg of said frame to enable said seat to be pivoted from a seating position below said frame when the frame is in the extended position to a storage position near said frame when the frame is in the retracted position, a seat back, means pivotally connecting said seat back to said seat independently of said links to enable said back to be moved between a generally upright position and a lower position immediately above and adjacent to said seat, and a safety catch movable between a position engageable with the table top when said frame is extended to aid in supporting said frame and said seat from the table top, and a retracted position out of engagement with the table top when the frame is in the retracted position.

2. A chair for small children comprising a frame, means for slidably supporting said frame below a table top to enable said frame to be slidably moved between a retracted position under said table top and an extended position in which a substantial portion of the frame extends beyond an edge of the table top, a seat carried by said frame, and a safety catch movably connected to said frame for movement between a position engagable with the table top when said frame is extended to aid in supporting said frame and said seat from the table top, and a retracted position out of engagement with the table top when the frame is in the retracted position.

3. A chair according to claim 2 characterized by said catch being pivotally supported by said frame for movement between the engagable position and the retracted position.

4. A chair according to claim 2 characterized by resilient means for urging said catch toward the engagable position from the retracted position.

5. A chair according to claim 2 characterized by said seat being pivotally connected to said frame by two pair of parallel links for moving said seat between a seating position below said frame and a storage position near the level of said frame, and a seat back pivotally connected to said seat independently of said parallel links.

6. A retractable chair for small children adaptable for connection to a table comprising a frame having two parallel legs, means for slidably supporting said frame below the top of the table for movement of said frame between a retracted position below the table top and an extended position in which a substantial portion of said frame extends beyond an edge of the table top, a seat, means for supporting said seat from said parallel legs and for enabling movement of said seat from a seating position below said frame when the frame is in the extended position to a storage position near said frame when the frame is in the retracted position, a seat back, means pivotally connecting said seat back to said seat independently of said supporting means to enable said back to be moved between a generally upright position and a lower position immediately above and overlaying said seat when said seat is in the storage position, and two foldable arms hingedly connected to side edge portions of said seat and foldable toward one another to positions substantially parallel to said seat when said frame is in the retracted position below the table top.

7. A retractable chair according to claim 6 characterized by the length of said arms being substantially equal to the depth of said seat.

8. A retractable chair according to claim 6 characterized by the height of each of said arms being less than half the width of said seat.

* * * * *

UNITED STATES PATENT OFFICE

CERTIFICATE OF CORRECTION

Patent No. 4,014,592 Dated 29 March, 1977

Inventor(s) Gist, Lanny J.

It is certified that error appears in the above-identified patent and that said Letters Patent are hereby corrected as shown below:

ON THE TITLE PAGE:

After, "Inventor: Lanny J. Gist, 840 Pearl St., Bowling Green, Ohio 43402", insert -- Assignee: Colorado Leisure Products, Inc. --.

Signed and Sealed this

First Day of November 1977

[SEAL]

*Attest:*

RUTH C. MASON
*Attesting Officer*

LUTRELLE F. PARKER
*Acting Commissioner of Patents and Trademarks*